US010186376B2

(12) United States Patent
Mikogami et al.

(10) Patent No.: US 10,186,376 B2
(45) Date of Patent: Jan. 22, 2019

(54) COIL COMPONENT COMPRISING A PLURALITY OF COATED CONDUCTIVE WIRES AND MANUFACTURING METHOD THEREOF

(71) Applicant: TDK Corporation, Tokyo (JP)

(72) Inventors: Tasuku Mikogami, Tokyo (JP); Nobuo Takagi, Tokyo (JP); Kouyu Ohi, Tokyo (JP); Syun Ashizawa, Tokyo (JP); Setu Tsuchida, Tokyo (JP)

(73) Assignee: TDK CORPORATION, Tokyo (JP)

( * ) Notice: Subject to any disclaimer, the term of this patent is extended or adjusted under 35 U.S.C. 154(b) by 21 days.

(21) Appl. No.: 15/201,742

(22) Filed: Jul. 5, 2016

(65) Prior Publication Data

US 2017/0011844 A1 Jan. 12, 2017

(30) Foreign Application Priority Data

Jul. 10, 2015 (JP) ..... 2015-139055
Jun. 30, 2016 (JP) ..... 2016-129830

(51) Int. Cl.
*H01F 41/069* (2016.01)
*H01F 27/28* (2006.01)
(Continued)

(52) U.S. Cl.
CPC ..... *H01F 41/069* (2016.01); *H01F 27/2828* (2013.01); *H01F 27/327* (2013.01); *H01F 41/127* (2013.01); *H01F 27/292* (2013.01)

(58) Field of Classification Search
CPC ..... H01F 41/066; H01F 17/045
See application file for complete search history.

(56) References Cited

U.S. PATENT DOCUMENTS 3,308,414 A * 3/1967 Ostrander ..... H01B 3/085 174/110 R
5,923,237 A * 7/1999 Sato ..... H03H 7/42 336/192
(Continued)

FOREIGN PATENT DOCUMENTS

JP 2001185421 A * 7/2001 ..... H01F 1/22
JP 2010165863 A * 7/2010
(Continued)

OTHER PUBLICATIONS

JP2001185421A, Jul. 2001, Machine Translation.*
(Continued)

*Primary Examiner* — Elvin G Enad
*Assistant Examiner* — Malcolm Barnes
(74) *Attorney, Agent, or Firm* — Young Law Firm, P.C.

(57) ABSTRACT

Disclosed herein is a coil component that includes: a drum core including a first flange portion, a second flange portion and a winding core portion positioned between the first and second flange portions; a plurality of coated conductive wires forming a first winding layer wound around the winding core portion and a second winding layer wound around the winding core portion with an intervention of the first winding layer; and a resin coating layer covering the coated conductive wires. A maximum space between the coated conductive wires in the first winding layer is narrower than a diameter of the coated conductive wires.

9 Claims, 11 Drawing Sheets

(51) Int. Cl.

| | |
|---|---|
| ***H01F 17/00*** | (2006.01) |
| ***H01F 27/32*** | (2006.01) |
| ***H01F 41/12*** | (2006.01) |
| *H01F 27/29* | (2006.01) |

(56) References Cited

U.S. PATENT DOCUMENTS

2003/0071704 A1* 4/2003 Toi ..... H01F 17/045 336/83
2008/0055034 A1* 3/2008 Tsunemi ..... H01F 3/10 336/83
2008/0309445 A1* 12/2008 Suzuki ..... H01F 27/2823 336/183
2010/0109827 A1* 5/2010 Asou ..... H01F 17/045 336/192
2010/0271160 A1* 10/2010 Tomonari ..... H01F 19/04 336/65
2011/0115592 A1* 5/2011 Kitajima ..... H01F 17/045 336/83
2011/0309906 A1* 12/2011 Muneuchi ..... H01F 17/045 336/221
2012/0133469 A1* 5/2012 Tomonari ..... H01F 3/14 336/192
2014/0292463 A1* 10/2014 Lai ..... H01F 27/29 336/192
2016/0133377 A1 5/2016 Takagi et al.
2017/0062122 A1* 3/2017 Kanbe ..... H01F 27/24
2017/0169924 A1* 6/2017 Uemoto ..... H01F 1/37

FOREIGN PATENT DOCUMENTS

JP 2012-119568 6/2012
JP 2012119568 A * 6/2012 ..... H01F 30/00

OTHER PUBLICATIONS

JP2010165863A, Jul. 2010, Machine Translation.*
USPTO Office Action dated Apr. 21, 2017 in U.S. Appl. No. 14/719,788.

* cited by examiner

COIL COMPONENT COMPRISING A PLURALITY OF COATED CONDUCTIVE WIRES AND MANUFACTURING METHOD THEREOF

BACKGROUND OF THE INVENTION

Field of the Invention

The present invention relates to a coil component and a manufacturing method of the coil component, and particularly to a coil component that uses a drum core and a manufacturing method thereof.

Description of Related Art

In recent years, electronic components that are used in information terminal devices such as smartphones have been strongly required to be smaller in size and lower in height. Therefore, as for coil components such as pulse transformers, surface-mount coil components that use drum cores instead of toroidal cores have been frequently used. For example, Japanese Patent Application Laid-Open No. 2012-119568 discloses a step-up transformer of a surface-mount type that uses a drum core.

The coil components that use drum cores have been required to be even smaller in size and lower in height. The size of a winding core portion has been decreasing from year to year. In order to secure a required inductance, a coated conductive wire that is thinner in diameter needs to be used.

However, the coated conductive wire that is thin in diameter is low in dielectric strength voltage. Accordingly, coil components that need to insulate primary and secondary windings, such as pulse transformers, may be insufficient in dielectric strength voltage. In particular, if wires are connected to terminal electrodes by thermo-compression bonding or laser bonding, heat that is applied at the time of wire connection is conveyed via core material of the coated conductive wire, and the coating film would be degraded. Therefore, the problem is that the component is likely to be insufficient in dielectric strength voltage.

The inventors hereof have studied the use of conductive wires coated with resin having a low melting point in order to provide a coil component having a high dielectric breakdown voltage. This is because scars and cracks, if any, in the resin coating, can be filled with the resin when the coated conductive wire is heated. This prevents a decrease in the dielectric breakdown voltage of the coated conductive wire.

Our study reveals, however, that if the resin film is too thick, it applies a high stress on the conductive wire as it is cooled. Consequently, the conductor filaments are greatly displaced.

The moving of coated conductive wires used does not influence the basic property (e.g., inductance) of the coil component. However, the study of the inventors hereof shows that if the coated conductive wires move much, the dielectric breakdown voltage of the coated conductive wire will more decreases a little than otherwise. This is probably because the distance between any adjacent coated conductive wires becomes short at some positions as the coated conductive wires move, intensifying the electric field between the primary winding and the secondary winding.

SUMMARY

It is therefore an object of this invention to provide a coil component having conductive wires coated with resin, and a method of fabricating this coil component, particularly to provide a coil component having high dielectric breakdown voltage and a method of fabricating the same.

A coil component according to one aspect of the present invention includes: a drum core including a first flange portion, a second flange portion and a winding core portion positioned between the first and second flange portions; a plurality of coated conductive wires forming a first winding layer wound around the winding core portion and a second winding layer wound around the winding core portion with an intervention of the first winding layer; and a resin coating layer covering the coated conductive wires. A maximum space between the coated conductive wires in the first winding layer is narrower than a diameter of the coated conductive wires.

The study of the inventors hereof shows that the breakdown voltage of a coil component using wires coated with a resin film decreases if the pace made in the first winding layer is narrower than the diameter of the coated conductive wires. In the coil component according to this aspect of the present invention, the coated conductive wires are inhibited from moving, and the maximum space between the coated conductive wires in the first winding layer is therefore less than the diameter of the coated conductive wires. Hence, the coil component can acquire a high breakdown voltage.

It is preferable that a maximum space between the coated conductive wires in the second winding layer is narrower than the diameter of the coated conductive wires. According to this feature, the coated conductive wires are strongly inhibited from moving, and the coil component can acquire a high breakdown voltage.

It is preferable that each of the first and second flange portions has a plurality of connection portions, and each end of the coated conductive wires is connected to an associated one of the connection portions. In this case, it is more preferable that the coated conductive wires include a primary and secondary windings insulated from each other. This is because most coil components of this type must have a high breakdown voltage.

It is preferable that each of the connection portions is substantially free from the resin coating layer. If the resin coating layer does not cover the connecting parts, it will not cause insufficient electrical connection or inadequate solder wettability.

In a method of manufacturing a coil component according to another aspect of the present invention, the method includes: winding a plurality of coated conductive wires around a winding core portion of a drum core to form a first winding layer wound around the winding core portion and a second winding layer wound around the winding core portion with an intervention of the first winding layer, each of the coated conductive wires including a core member, a coating film covering the core member, and a resin film covering the coating film; connecting both ends of the coated conductive wires to connection portions provided on the first and second flange portions of the drum core; and melting the resin film to form a resin coating layer covering the coated conductive wires. A maximum space between the coated conductive wires in the first winding layer is narrower than a diameter of the coated conductive wires.

According this aspect of the present invention, the resin coating layer is formed as the resin film is melted. Scars, if any, are removed from the resin film, enhancing the dielectric breakdown voltage of the coil component. Moreover, the number of steps does not increase because any resin need not be applied after the coated conductive wires have been wound. Further, the coil component can acquire a high breakdown voltage because the coated conductive wires are inhibited from moving as the resin coating layer shrinks.

According to the present invention, the connecting is preferably carried out by thermo-compression bonding or laser bonding. The reason is that, if the wire is connected by thermo-compression bonding or laser bonding, the dielectric strength voltage tends to become insufficient due to the heat applied at the time of the wire connection.

In this case, the coated conductive wires preferably include a first coated conductive wire that is located in the first winding layer in the winding core portion and a second coated conductive wire that is located in a second or subsequent winding layer in the winding core portion, and the connecting includes a step of connecting the first coated conductive wire to the wire connection portion and then the second coated conductive wire to the wire connection portion. The reason is that, if the wire connection work is carried out multiple times on the same wire connection portions as described above, the effects of the heat become more significant.

The method of producing the coil component of the present invention preferably further includes bonding a plate core to the first and second flange portions, wherein the resin film melts due to heat applied at the bonding step. According to this method, the step of bonding the plate core and the step of melting the resin film can be performed at the same time.

Thus, the present invention can provide a coil component having wires coated with resin, and a method of producing this coil component, particularly a coil component having high dielectric breakdown voltage and a method of fabricating the same.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
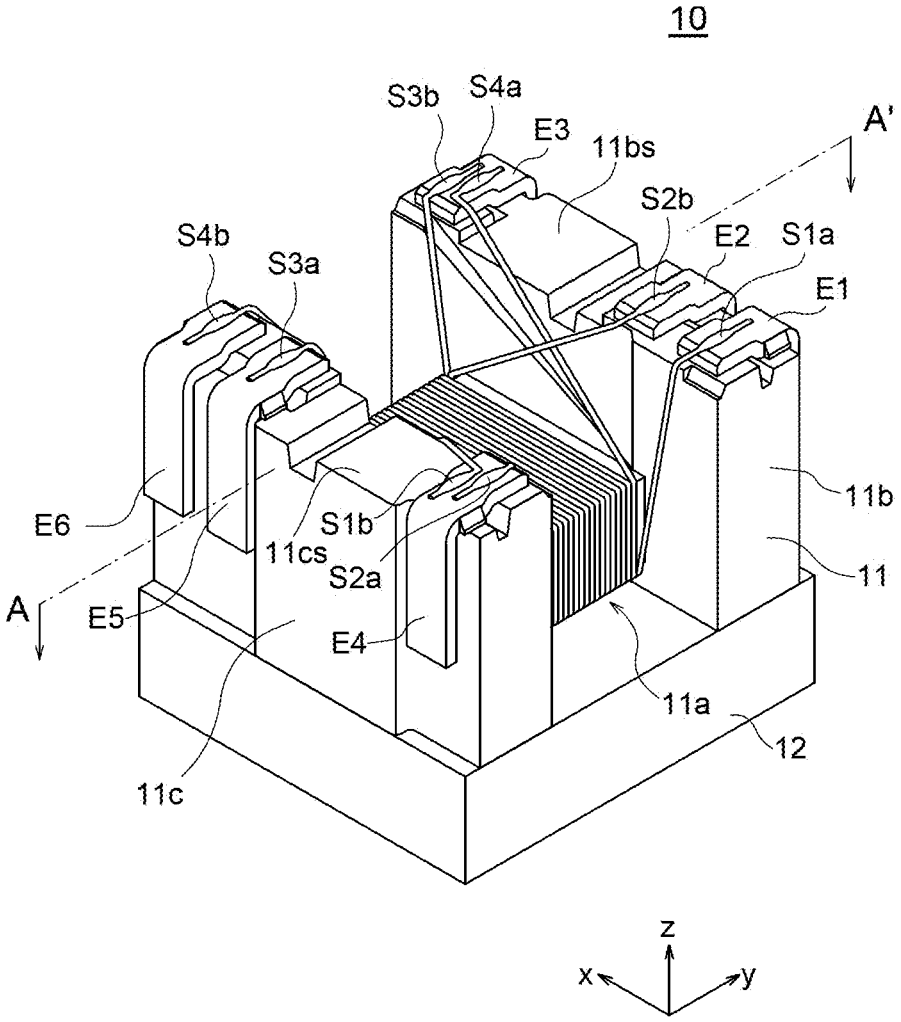
FIG. 1 is a schematic perspective view showing the appearance structure of a coil component according to a first embodiment of the present invention.

FIG. 1 is a schematic perspective view showing the appearance structure of a coil component 10 according to the first embodiment of the present invention.

The coil component 10 of the present embodiment is a pulse transformer of a surface-mount type. As shown in FIG. 1, the coil component 10 includes a drum core 11, a plate core 12 that is bonded to the drum core 11, and coated conductive wires S1 to S4 that are wound around a winding core portion 11*a* of the drum core 11. The coil component of the present invention is not limited to the pulse transformer. The coil component of the present invention may be any other transformer component such as a balun transformer or step-up transformer, or may be a filter component such as a common mode choke coil.

The drum core 11 and the plate core 12 are made of a magnetic material that is relatively high in magnetic permeability such as a sintered composite of Ni—Zn ferrite or Mn—Zn ferrite, for example. Incidentally, the magnetic material that is high in magnetic permeability such as Mn—Zn ferrite is usually low in specific resistance and electrically conductive.

The drum core 11 includes the rod-shaped winding core portion 11*a*, and first and second flange portions 11*b* and 11*c* that are provided at both ends in y-direction of the winding core portion 11*a*. The winding core portion 11*a* and flange portions 11*b* and 11*c* are integrally formed. The coil component 10 is a component that is mounted on a surface of a printed circuit board at the time of actual use. The coil component 10 is mounted in such a way that z-direction upper surfaces 11*bs* and 11*cs* of the flange portions 11*b* and 11*c* face the printed circuit board. To the opposite sides, or lower surfaces, of the flange portions 11*b* and 11*c* from the upper surfaces 11*bs* and 11*cs*, the plate core 12 is bonded with an adhesive. According to this structure, a closed magnetic circuit is formed by the drum core 11 and the plate core 12.

On the upper surface 11*bs* of the first flange portion 11*b*, three wire connection portions E1 to E3 that serve as terminal electrodes are provided. On the upper surface 11*cs* of the second flange portion 11*c*, three wire connection portions E4 to E6 that serve as terminal electrodes are provided. The wire connection portions E1 to E6 include L-shaped terminal metal fittings that are attached to the corresponding flange portions 11*b* and 11*c*. However, the terminal metal fittings are not necessarily required to be used. The wire connection portions E1 to E6 may be formed by conductor film that is burned into the surfaces of the corresponding flange portions 11*b* and 11*c*. The wire connection portions E1 to E3 are arranged in this order from one end side in x-direction as shown in FIG. 1. Similarly, the wire connection portions E4 to E6 are arranged in this order from one end side in x-direction. Ends of the coated conductive wires S1 to S4 are connected to the wire connection portions E1 to E6 by thermo-compression bonding or laser bonding.

As shown in FIG. 1, the distance between the wire connection portions E2 and E3 is designed in such a way as to be greater than the distance between the wire connection portions E1 and E2. Similarly, the distance between the wire connection portions E4 and E5 is designed in such a way as to be greater than the distance between the wire connection portions E5 and E6. This configuration is intended to improve the withstand voltage between a primary winding that is formed by the coated conductive wires S1 and S2 and a secondary winding that is formed by the coated conductive wires S3 and S4.

The coated conductive wires S1 to S4 include a core material (metal core) that is made of a good conductor, and an insulating coating film that covers the core material. The coated conductive wires S1 to S4 are wound around the winding core portion 11*a* in a double-layered structure. While the details will be described later, the coated conductive wires S1 and S4 are wound around the winding core portion 11*a* in a bifilar winding pattern in order to form a first winding layer, and the coated conductive wires S2 and S3 are wound around the winding core portion 11*a* in a bifilar winding pattern in order to form a second winding layer. The numbers of turns of the coated conductive wires S1 to S4 may be equal.

The winding direction of the coated conductive wires S1 to S4 is different between the first and second winding layers. When the winding direction from the first flange portion 11*b* to the second flange portion 11*c* is seen from the flange portion 11*b*'s side, the winding direction of the coated conductive wires S1 and S4 is counterclockwise, and the winding direction of the coated conductive wires S2 and S3 is clockwise. In this manner, the winding direction of the coated conductive wires S1 and S4 is opposite to the winding direction of the coated conductive wires S2 and S3.

One end S1*a* and the other end S1*b* of the coated conductive wire S1 are connected to the wire connection portions E1 and E4, respectively. One end S4*a* and the other end S4*b* of the coated conductive wire S4 are connected to the wire connection portions E3 and E6, respectively. One end S2*a* and the other end S2*b* of the coated conductive wire S2 are connected to the wire connection portions E4 and E2, respectively. One end S1*a* and the other end S1*b* of the coated conductive wire S3 are connected to the wire connection portions E5 and E3, respectively.

Figure 2:
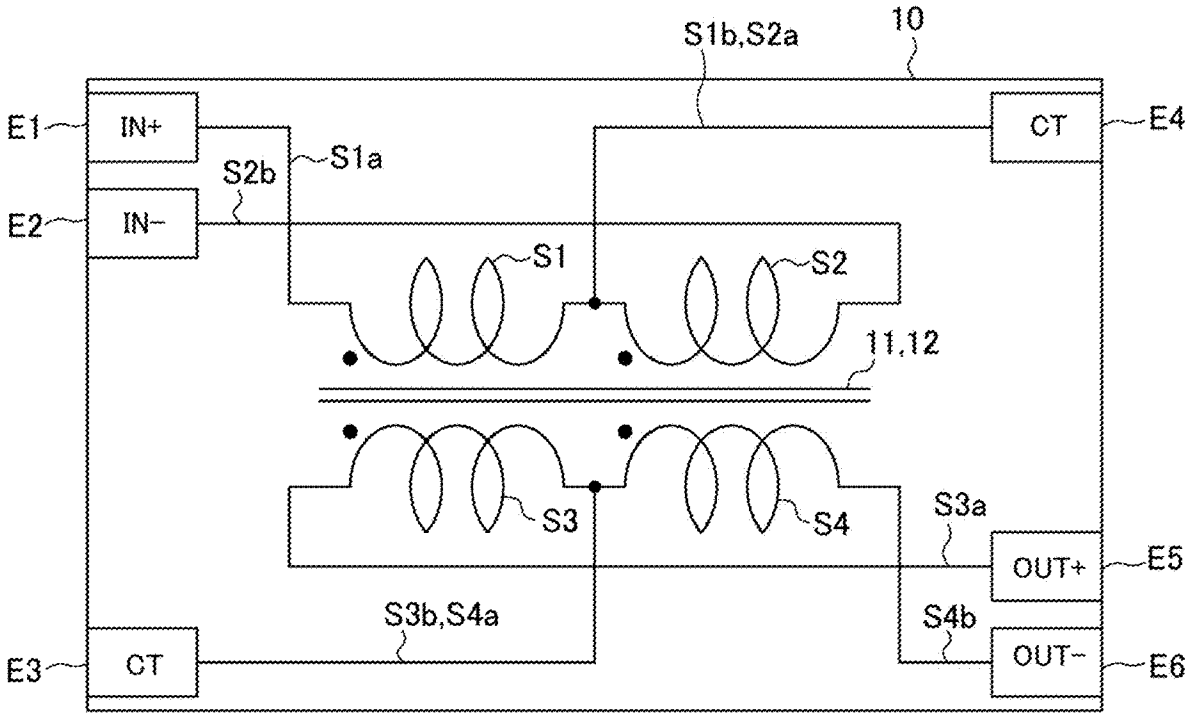
FIG. 2 shows an equivalent circuit of the coil component shown in FIG. 1.

FIG. 2 shows an equivalent circuit of the coil component 10 according to the present embodiment.

As shown in FIG. 2, the wire connection portions E1 and E2 are used as balanced-input positive terminal IN+ and negative terminal IN−, respectively. The wire connection portions E5 and E6 are used as balanced-output positive terminal OUT+ and negative terminal OUT−, respectively. The wire connection portions E3 and E4 are used as output-side center tap CT and input-side center tap CT, respectively. The coated conductive wires S1 and S2 constitute the primary winding of the pulse transfer. The coated conductive wires S3 and S4 constitute the secondary winding of the pulse transfer.

Figure 3:
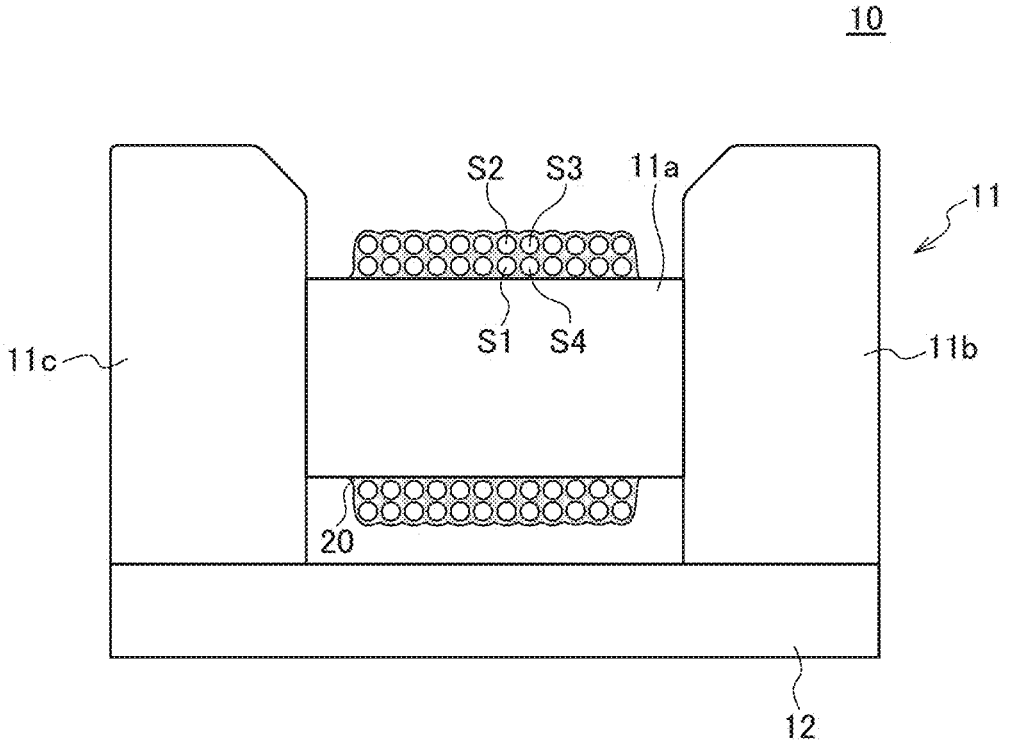
FIG. 3 is a cross-sectional view taken along line A-A' shown in FIG. 1.

FIG. 3 is a cross-sectional view taken along line A-A' shown in FIG. 1.

As shown in FIG. 3, the coated conductive wires S1 and S4 are wound as the first winding layer on the winding core portion 11*a* of the drum core 11. The coated conductive wires S2 and S3 are wound as the second winding layer on the first winding layer. That is, the coated conductive wires S1 to S4 that are wound around the winding core portion 11*a* have a double-layered structure. At least the surfaces of the coated conductive wires S1 and S4 that are located in the first winding layer are covered with a resin coating layer 20. The resin coating layer 20 is made of an insulating resin material that is low in melting point, such as polyester, for example. The resin coating layer 20 preferably cover the coated conductive wires S2 and S3 that are located in the second winding layer. According to the present embodiment, particularly the upper surfaces of the coated conductive wires S2 and S3 that are located in the second winding layer may be partially covered due to a production method described later.

Figure 4:
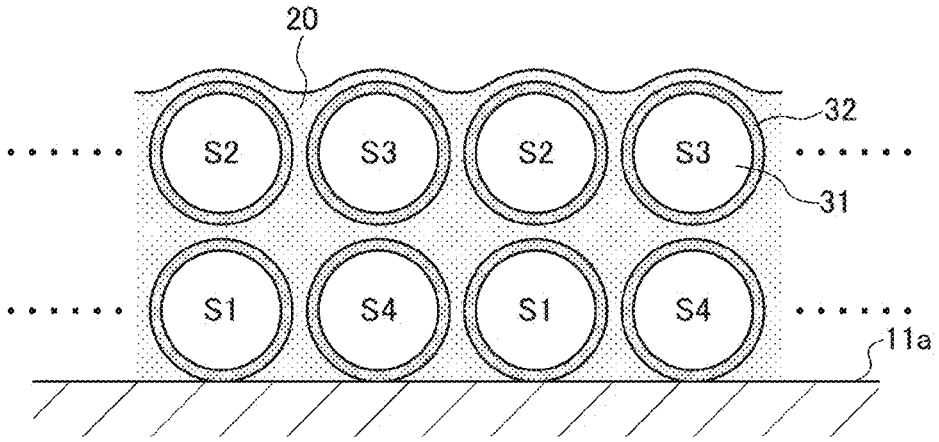
FIG. 4 is an enlarged cross-sectional view of a part of first and second winding layers.

FIG. 4 is an enlarged cross-sectional view of a part of first and second winding layers.

As shown in FIG. 4, the coated conductive wires S1 to S4 have the structure in which the core material (metal core) 31 is covered with a coating film (insulating film) 32. The resin coating layer 20 is provided in such a way as to cover the coating film 32 of the coated conductive wires S1 to S4. As for the coated conductive wires S1 and S4 that are located in the first winding layer, almost no area of the coating film 32 is exposed, and almost the entire area is covered with the resin coating layer 20. As for the coated conductive wires S2 and S3 that are located in the second winding layer, it is preferable that almost no area of the coating film 32 is exposed, and almost the entire area may be covered with the resin coating layer 20.

In that manner, in the coil component 10 of the present embodiment, the coated conductive wires S1 to S4 are covered with the resin coating layer 20. Therefore, defective portions of the coating film 32, such scratches and cracks, can be filled with the resin coating layer 20. Accordingly, it is possible to prevent a decline in dielectric strength voltage associated with the defective portions, and to secure a high dielectric strength voltage.

It is preferable that the resin coating layer 20 exists only on the winding core portion 11*a* of the drum core 11. In other words, it is preferable that no resin coating layer 20 exists on the flange portions 11*b* and 11*c*. This means that no resin coating layer 20 may exist between the flange portions 11*b* and 11*c* and the plate core 12, and that the wire connection portions E1 to E6 may be not covered with the resin coating layer 20.

Figure 5:
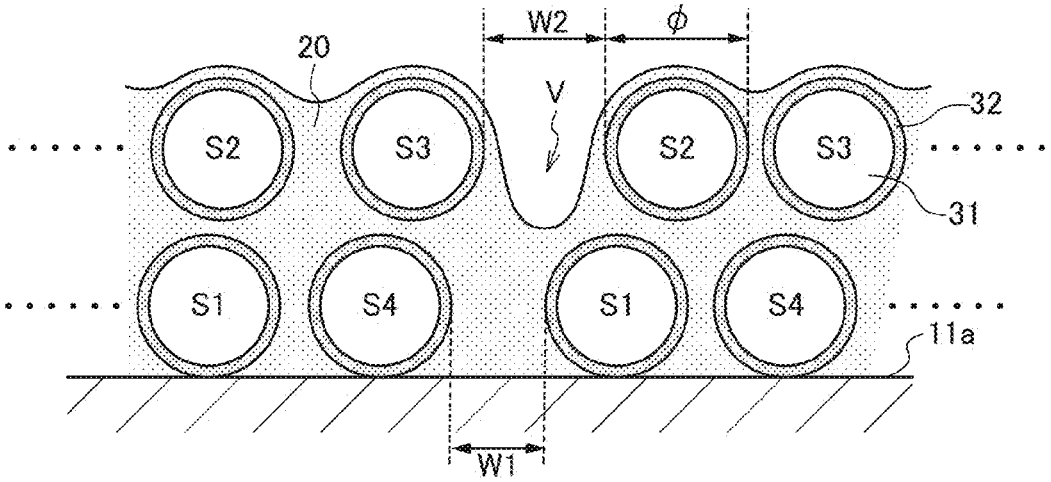
FIG. 5 is an enlarged cross-sectional view of a part of first and second winding layers.

As shown in FIG. 4, the coated conductive wires S1 and S4 are alternately arranged in the first winding layer, and the coated conductive wires S2 and S3 are alternately arranged in the second winding layer. As the resin coating layer 20 molten due to the thermal load applied during the production and mounting is cooled, a stress is applied to the coated conductive wires S1 to S4. The coated conductive wires S1 to S4 aligned one with another may therefore move in part as shown in FIG. 5. Consequently, the space between the adjacent coated conductive wires S1 and S4 changes, and so does the space between the adjacent coated conductive wires S2 and S3.

In the coil component 10 according to this embodiment, however, the coated conductive wires S1 to S4 are inhibited from moving. Therefore, the maximum space W1 between the coated conductive wires S1 and S4 is less than the diameter $\phi$ of the coated conductive wires S1 to S4. In other words, no spaces equal to or larger than the diameter $\phi$ exist in the first winding layer. It is desired that the maximum space W2 between the coated conductive wires S2 and S3 should also be less than the diameter $\phi$ of the coated conductive wires S1 to S4. It is also desired that the maximum space W1 is less than the maximum space W2.

In the instance of FIG. 5, a relatively large space W2 exists between the adjacent coated conductive wires S2 and S3, and a void V lies between these wires. The void V may reach the first winding layer. Even in this case, the maximum space W1 in the first winding layer should preferably less than the diameter ϕ of the coated conductive wires.

The reason why the maximum space W1 in the first winding layer should less than the diameter ϕ of the coated conductive wires is as follows.

As will be described later in detail, the resin coating layer 20 is made of a resin film (molten layer) applied to the surfaces of the coated conductive wires S1 to S4. The amount of resin used can be adjusted in accordance with the thickness of the resin coating layer 20. If the resin film is too thick, however, the coated conductive wires S1 to S4 aligned well by virtue of the stress contracting the resin coating layer 20 will move much as the molten resin is cooled and solidified. The coated conductive wires S1 to S4 are therefore no longer be aligned with one another. As a result, the adjacent coated conductive wires S1 and S4 or the adjacent coated conductive wires S2 and S3 may contact to each other at a specific part, inevitably decreasing the breakdown voltage. In addition, the resin coating layer 20, which is excessively thick, intensifies the electric field between any two adjacent coated conductive wires, further decreasing the breakdown voltage.

The breakdown voltage is lowed very much if the maximum space W1 between the coated conductive wires S1 and S4 constituting the first winding layer increases to a value equal to or greater than diameter ϕ of the coated conductive wires S1 and S4. That is, if the space W1, which has an initial value of less than diameter ϕ, increases to a value equal to or greater than diameter ϕ, the breakdown voltage will decrease. This is a sign of decreasing a breakdown voltage. It is therefore necessary to reduce the thickness of the resin film to such a value as would not decrease the breakdown voltage.

A manufacturing method of the coil component 10 according to the present embodiment will be described.

Figure 6:
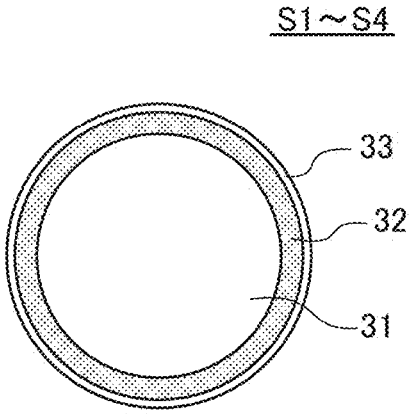
FIG. 6 is a cross-sectional view of a coated conductive wire.

As shown in FIG. 6, the coated conductive wires S1 to S4 of a three-layer structure that includes the core material 31, the coating film 32, and a resin film 33 are prepared. The core material 31 is made of a good conductor such as copper (Cu), and the surface thereof is covered with the coating film 32. The coating film 32 is made of insulating material such as imide-modified polyurethane, and the surface thereof is covered with the thin resin film 33. The resin film 33 is made of insulating resin material such as polyester. The material of the resin film 33 is selected in such a way as to have a melting point that is sufficiently lower than that of the coating film 32. In one example, the melting point of imide-modified polyurethane is about 260 degrees Celsius, while the melting point of polyester is about 70 degrees Celsius. A thickness of the resin film 33 is designed to be sufficiently thin as long as defective portions of the coating film 32 can be properly repaired.

Figure 7A:
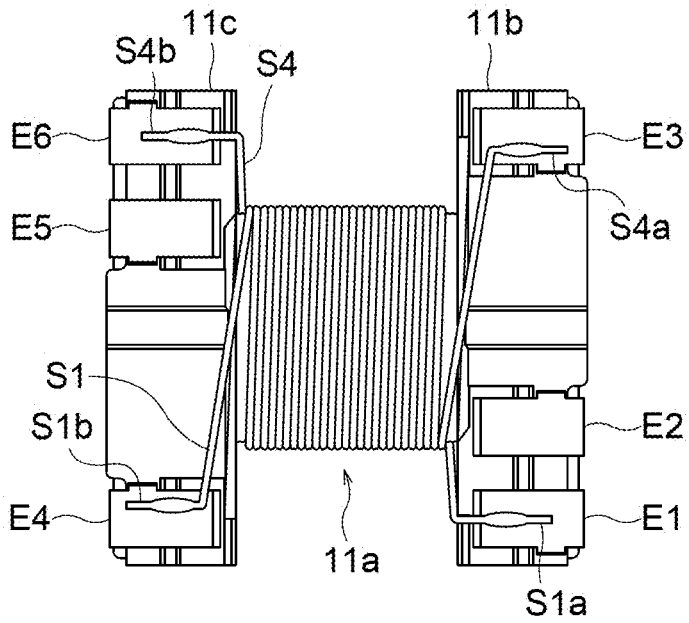
FIG. 7A is a schematic plan view indicating a state where two coated conductive wires are wound around a winding core portion in a first layer.

As shown in FIG. 7A, the coated conductive wires S1 and S4 are wound around the winding core portion 11*a* in a bifilar winding pattern, and both ends of each of the coated conductive wires S1 and S4 are connected to the corresponding wire connection portions E1, E3, E4, and E6 in order to form the first winding layer. More specifically, one ends S1*a* and S4*a* of the coated conductive wires S1 and S4 are connected by thermo-compression bonding or laser bonding to the wire connection portions E1 and E3, respectively. Then, the drum core 11 is rotated in one direction in order to wound the coated conductive wires S1 and S4 around the winding core portion 11*a*. After the rotation of the drum core 11 is stopped, the other ends S1*b* and S4*b* of the coated conductive wires S1 and S4 are connected by thermo-compression bonding or laser bonding to the wire connection portions E4 and E6, respectively. During this process, the heat generated by the thermo-compression bonding or laser bonding is conveyed via the core material 31. Accordingly, in portions close to the ends, the coating film 32 of the coated conductive wires S1 and S4 might be degraded, and defective portions, such as scratches or cracks, could emerge. Furthermore, due to mechanical stress that occurs at the time of winding, the coating film 32 could become defective. Moreover, when the thermo-compression bonding or laser bonding is carried out, the resin film 33 that exists at the one ends S1*a* and S4*a* of the coated conductive wires S1 and S4 and at the other ends S1*b* and S4*b* would change in quality due to the heat. According to the present invention, the resin that has changed in quality due to the heat at the time of wire connection is not part of the resin coating layer 20.

Immediately after the coated conductive wires S1 and S4 are wound, they should better be aligned, closely positioned to each other with the resin coating layer 20 interposed between them, though it is not absolutely necessary to do so. According to this structure, a maximum density in the first winding layer can be obtained, and the maximum numbers of turns can be obtained. Nonetheless, it is not absolutely required that all turns of the coated conductive wire S1 contact all turns of the coated conductive wire S4, respectively, immediately after the coated conductive wires S1 and S4 are wound. Some turns of the coated conductive wire S1 may be spaced apart from the adjacent coated conductive wire S4. Even in this case, the maximum space W1 between the coated conductive wires S1 and S4 must be less than the diameter ϕ of the coated conductive wires. If the maximum space W1 is equal to or larger than the diameter ϕ, the coated conductive wires S2 and S3 forming the second winding layer cannot be properly formed.

Figure 7B:
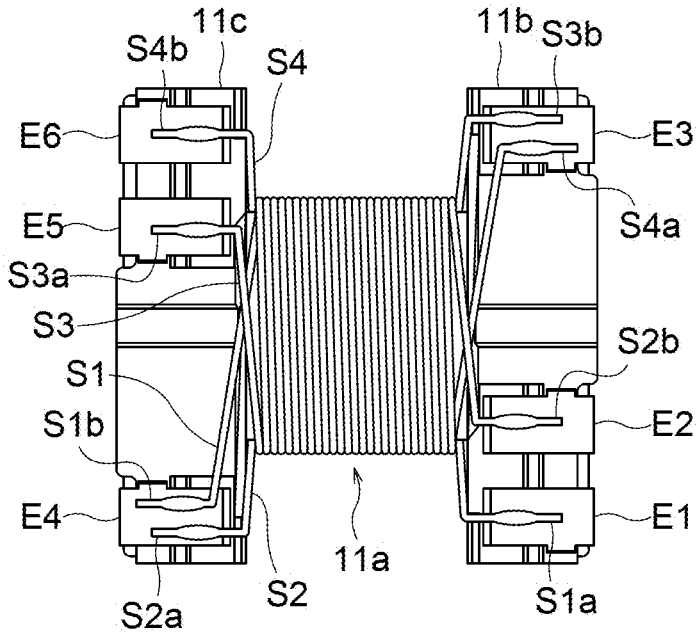
FIG. 7B is a schematic plan view indicating a state where another two coated conductive wires are further wound around the winding core portion in a second layer.

Then, as shown in FIG. 7B, the coated conductive wires S2 and S3 are wound around the winding core portion 11*a* in a bifilar winding pattern, and both ends of each of the coated conductive wires S2 and S3 are connected to the corresponding wire connection portions E2, E3, E4, and E5 in order to form the second winding layer. More specifically, the other ends S2*b* and S1*b* of the coated conductive wires S2 and S3 are connected by thermo-compression bonding or laser bonding to the wire connection portions E2 and E3, respectively. Then, the drum core 11 is rotated in the opposite direction in order to wound the coated conductive wires S2 and S3 around the winding core portion 11*a*. After the rotation of the drum core 11 is stopped, one ends S2*a* and S1*a* of the coated conductive wires S2 and S3 are connected by thermo-compression bonding or laser bonding to the wire connection portions E4 and E5, respectively.

If the coated conductive wires S1 and S4 forming the first winding layer contact each other or if the maximum space is less than diameter ϕ immediately after the coated conductive wires S1 and S4 are wound, the coated conductive wires S2 and S3 can be correctly wound on the first winding layer so that they may constitute the second winding layer. Conversely, if a space equal to or larger than the diameter ϕ exists between the coated conductive wires S1 and S4 immediately after the coated conductive wires S1 and S4 are wound, the coated conductive wire S2 or S3 falls into this space. In this case, the second winding layer cannot be correctly formed. This is why the maximum space W1 between the coated conductive wires S1 and S4 is less than the diameter ϕ of the coated conductive wires immediately the coated conductive wires S1 and S4 are wound.

When the coated conductive wire S2 is connected, at one end, to the connecting part E2, and at the other end, to the connecting part E3, and the coated conductive wire S3 is connected, at one end, to the connecting part E4, and at the other end, to the connecting part E5, those parts of the resin film 33 existing at the ends of the coated conductive wires S2 and S3, respectively, are affected by the heat applied to them. Further, those parts of the coat film 32, which are close to the ends of the coated conductive wires S1 to S4, are deteriorated because heat is conveyed to the coated conductive wires S1 to S4 via the core member 31 during the thermo-compression bonding or laser bonding.

The coated conductive wires S1 and S4 suffer thermal damage twice, from the heat generated by the thermo-compression bonding or laser bonding during the formation of the first winding layer and from the heat generated by the thermo-compression bonding or laser bonding during the formation of the second winding layer. Therefore, the coating film. 32 is likely to degrade. That is, the coated conductive wires S1 and S4 that constitute the first winding layer suffers greater damage than the coated conductive wires S2 and S3 that constitutes the second winding layer. Therefore, defective portions such as scratches or cracks are more likely to emerge in the coating film 32 of the coated conductive wires S1 and S4.

After the work to wind the coated conductive wires S1 to S4 is completed, the plate core 12 is bonded to the drum core 11. More specifically, a small amount of adhesive is applied to the flange portions 11*b* and 11*c* of the drum core 11. Then, the plate core 12 is placed on the flange portions 11*b* and 11*c* of the drum core 11. Then, thermal treatment is carried out to solidify the adhesive, and the plate core 12 is firmly fixed to the drum core 11 as a result. This thermal treatment is carried out at 150 degrees Celsius for about one hour, for example.

The resin film 33 that exists on the surfaces of the coated conductive wires S1 to S4 melts during the thermal treatment, and is infiltrated into gaps between the coated conductive wires S1 to S4. If defective portions F such as scratches or cracks exist on the coating film 32, the defective portions are filled with the resin coating layer 20 which is the melted resin film 33. The resin coating layer 20 which is the melted resin film 33 gathers around the coated conductive wires S1 and S4 located in the first winding layer because of capillarity. Therefore, at least almost the entire area of the first layer is covered with the resin coating layer 20. On the other hand, mainly the upper surface of the second winding layer may not be covered with the resin coating layer 20, and the coating film 32 is sometimes being exposed. Incidentally, the resin film 33 that exists in the wire connection portions E1 to E6 has already changed in quality due to the heat at the time of wire connection. The resin film 33 therefore does not melt during the thermal treatment.

When the heating is terminated, the resin coating layer 20 molten is cooled and solidifies. The stress generated as the resin coating layer 20 solidifies moves the coated conductive wires S1 to S4 move out of mutual alignment, generating a space between the any adjacent coated conductive wires. In this embodiment, however, the resin film. 33 formed on the wires S1 to S4 is thin, and the resin coating layer 20 is not excessively thick. Hence, the maximum space W1 in at least the first winding layer can be reduced to less than diameter ϕ of the coated conductive wires. In other words, in the first winding layer, the maximum space W1 which is less than the diameter ϕ immediately after winding the coated conductive wires S1 and S4 remains less than the diameter ϕ, never increasing over diameter ϕ. Preferably, the maximum space W2 remains less than the diameter ϕ, never increasing over diameter ϕ, also in the second winding layer.

As seen from the above, a phenomenon that the maximum space W1 in the first winding layer increases to or over the diameter ϕ is a sign that the breakdown voltage at both the primary winding and the secondary winding will decrease. In view of this, in order not to appear the sign, the resin film 33 is thin enough to prevent the breakdown voltage from decreasing in the primary winding or the secondary winding.

Through the steps described above, the coil component 10 of the present embodiment is completed.

As described above, according to the present embodiment, the coated conductive wires S1 to S4 whose surface is covered with the resin film 33 are used. Then, thermal treatment is carried out so that the resin film 33 melts. In this manner, the resin coating layer 20 is formed. As a result, at least the surfaces of the coated conductive wires S1 and S4 that are located in the first layer are automatically covered with the resin coating layer 20. As described above, the coated conductive wires S1 and S4 that are located in the first winding layer suffer thermal damage twice, and defective portions are likely to emerge in the coating film 32. However, according to the present embodiment, the surfaces of the coated conductive wires S1 and S4 that are located in the first winding layer are automatically covered with the resin coating layer 20. Therefore, it is possible to ensure that defective portions that emerge in the coating film 32 in the first winding layer are filled with the resin coating layer 20. Even if defective portions emerge in the coating film 32, it is possible to secure a sufficient dielectric strength voltage.

Another possible method is to coat with the resin material after the coated conductive wires S1 to S4 are wound around the winding core portion 11*a* in order to improve the dielectric strength voltage. However, if the viscosity of the resin material is high, the coated conductive wires S1 to S4 cannot be sufficiently coated. If the viscosity of the resin material is low, the resin material can get into the flange portions 11*b* and 11*c* of the drum core 11 because of capillarity. Particularly in the case of a coil component that is low in height with a small difference in height between the winding core portion 11*a* and the flange portions 11*b* and 11*c*, the inflow of the resin material inevitably occurs due to capillarity.

If the resin material flows to the lower surfaces of the flange portions 11*b* and 11*c*, the flow of the resin material creates a gap between the flange portions 11*b* and 11*c* and the plate core 12, resulting in a decrease in magnetic properties. If the resin material flows to the upper surfaces 11*bs* and 11*cs* of the flange portions 11*b* and 11*c*, the wire connection portions E1 to E6 that are terminal electrodes may be partially covered with the resin material, leading to a decrease in solder wettability at the time of implementation.

According to the present embodiment, the coated conductive wires S1 to S4 that are wound are not coated later with the resin material. The winding work is performed with the use of the coated conductive wires S1 to S4 on the surfaces of which the resin film 33 is provided in advance. After that, the resin film 33 is melted to form the resin coating layer 20, thereby eliminating the risk that the resin material could flow into the flange portions 11*b* and 11*c*. Furthermore, it is possible to ensure that the resin coating layer 20 covers the first winding layer constituted of the coated conductive wires S1 and S4 in which defective portions are more likely to occur.

As has been described, the coated conductive wires S1 and S4 are covered with the resin coating layer 20 in the coil component 10 according to this embodiment. Hence, the coil component can have sufficient dielectric breakdown voltage even if the coated conductive wires used have a small diameter. Further, neither the magnetic property nor the solder wettability are degraded, because the resin coating layer 20 never reach the flange parts 11*b* and 11*c*.

Moreover, the resin coating layer 20 would not become excessively thick in this embodiment. This is because the resin film 33 the coated conductive wires S1 to S4 have a thin resin film 33. Therefore, the sign of decreasing the breakdown voltage does not appear.

Figure 8:
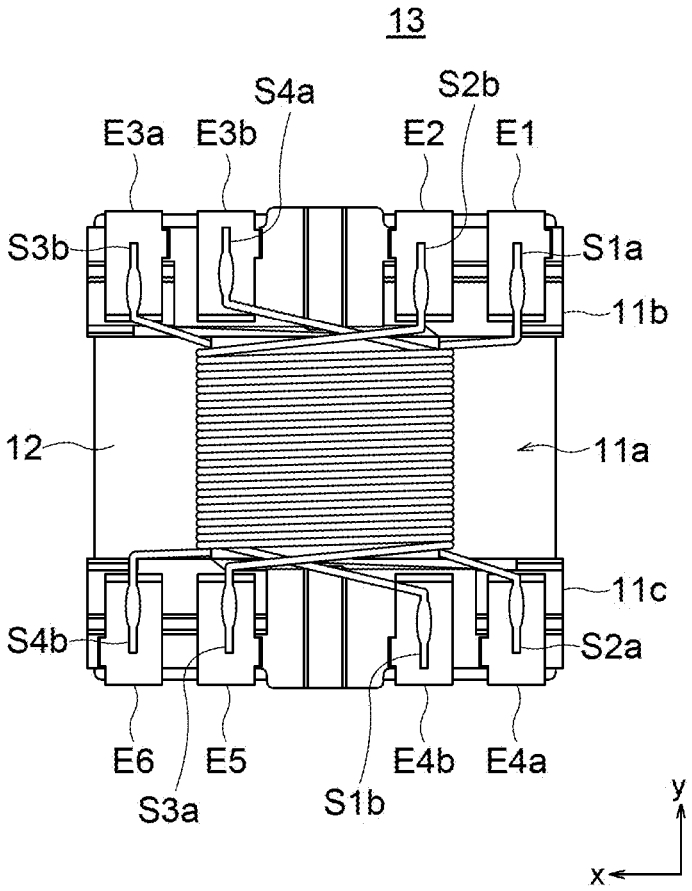
FIG. 8 is a schematic plan view showing the configuration of a coil component according to a second embodiment of the present invention.

FIG. 8 is a schematic plan view showing the configuration of a coil component 13 according to the second embodiment of the present invention, showing the configuration of a bottom surface side.

As shown in FIG. 8, the coil component 13 of the second embodiment is characterized in that the number of wire connection portions provided in each of the flange portions 11*b* and 11*c* is not 3 but 4. In the flange portion 11*b*, four wire connection portions E1, E2, E3*a*, and E3*b* are provided. In the flange portion 11*c*, four wire connection portions E4*a*, E4*b*, E5, and E6 are provided. An electrical connection between the other end S1*b* of the coated conductive wire S1 and one end S2*a* of the coated conductive wire S2 is achieved by a wiring pattern or land pattern on a printed circuit board at a time when the coil component 13 is mounted. Similarly, an electrical connection between the other end S1*b* of the coated conductive wire S3 and one end S4*a* of the coated conductive wire S4 is achieved by a wiring pattern or land pattern on a printed circuit board at a time when the coil component 13 is mounted. The rest of the configuration is the same as that of the coil component 10 of the first embodiment. Therefore, the same components will be represented by the same reference symbols, and will not be described again.

In that manner, in the coil component 13 of the present embodiment, the two wire connection portions E3*a* and E3*b* are short-circuited on the printed circuit board. Furthermore, the two wire connection portions E4*a* and E4*b* are short-circuited on the printed circuit board. Accordingly, it is possible to realize the same structure as that of the coil component 10 of the first embodiment. Thus, it is possible to achieve the same operation and advantageous effects as the first embodiment.

Figure 9:
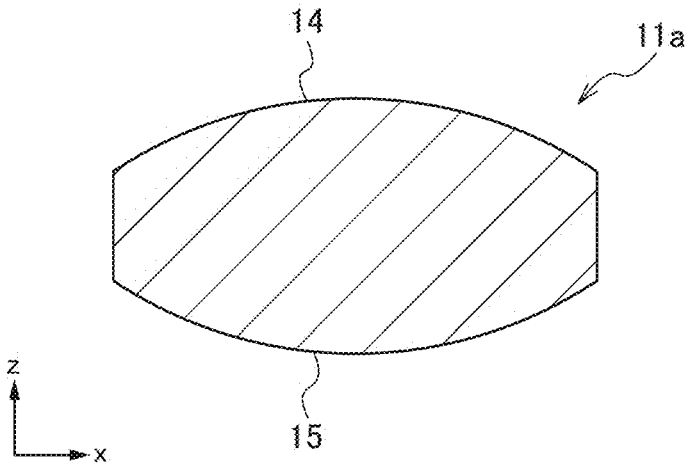
FIG. 9 is a cross-sectional view showing one example of an xz cross-section of a winding core portion of a drum core.

FIG. 9 is a cross-sectional view showing one example of an xz cross-section of a winding core portion 11*a* of a drum core 11.

In the example shown in FIG. 9, an upper surface 14 and lower surface 15 of the winding core portion 11*a* are arc-shaped. If the winding core portion 11*a* that has such an arc-shaped cross-section is used, the melted resin film 33 is infiltrated into the corners of the winding core portion 11*a* more easily than when a winding core portion 11*a* that is rectangular in cross-section is used. As a result, it is possible to ensure that the resin coating layer 20 covers the coated conductive wires S1 and S4 that are located at the corners of the winding core portion 11*a*. If the winding core portion 11*a* is elliptical or circular in cross-section, there are no corners. Therefore, it is possible to ensure that the resin coating layer 20 covers the coated conductive wires S1 and S4.

It is apparent that the present invention is not limited to the above embodiments, but may be modified and changed without departing from the scope and spirit of the invention.

In the embodiments described above, the coated conductive wires are wound around the winding core, forming two winding layers. The coil component according to this invention is not limited to this configuration, nevertheless. The coated conductive wires may be wound around the winding core to form three or more winding layers.

Further, the method of winding the coated conductive wires is not limited to a particular one. Both the wires on the first winding layer and the wires on the second winding layer may be wound by a bifilar winding such as the embodiments described above. Alternatively, the coated conductive wires may be wound, one by one.

EXAMPLES

A drum core 11 was prepared, 4.5 mm long in the x direction, 3.2 mm wide in the y direction and 2.9 mm high in the z direction. Further, coated conductive wires S1 to S4 were prepared, each comprising a core member 31 having a diameter of 40 μm, a coat film 32 having thickness of 10 μm and a resin film 33 having thickness of 1 μm or 3.5 μm. The coated conductive wires S1 to S4 were wound around the drum core 11, by using the method described with reference to FIG. 7. However, connecting parts E1 to E6 were not formed, making the coated conductive wires S1 to S4 open at both ends. Thus, samples A and B of the coil component were produced. The sample A has coated conductive wires S1 to S4, each comprising a resin film 33 having thickness of 1 μm. The sample B has coated conductive wires S1 to S4, each comprising a resin film 33 having thickness of 3.5 μm.

Next, a thermal load was applied to the resin film 33, melding the resin film 33. Then, the resin film 33 was cooled, thereby forming a resin coating layer 20. The thermal load was applied twice, first in such a way as in the adhering the plate-shaped core, and then in such away as in the re-flowing to mount the coil component. Then, the maximum space W1 in the first winding layer was measured. The measuring results were as shown in FIG. 10.

Figure 10:
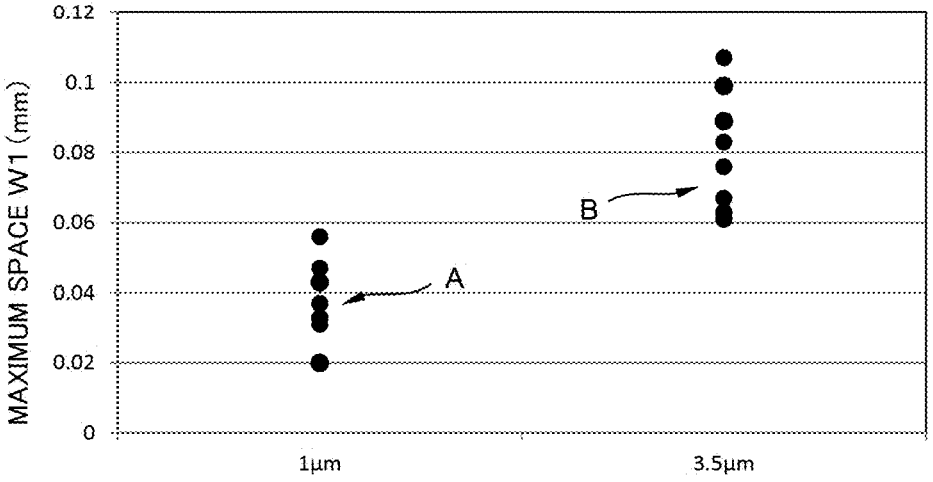
FIG. 10 is a graph indicating measurement results of a maximum space.

As seen from FIG. 10, the maximum space W1 in the first winding layer was 20 μm to 56 μm in the sample A having coated conductive wires S1 to S4, each having a resin film 33 having thickness of 1 μm. In the sample B having coated conductive wires S1 to S4, each having a resin film 33 having thickness of 3.5 μm, the maximum space W1 in the first winding layer was 61 μm to 107 μm. Thus, the maximum space W1 in the first winding layer did not exceed the diameter ϕ (i.e., 60 μm) of the coated conductive wires in the sample A even after the coated conductive wires S1 to S4 have moved due to the thermal load, but exceeded the diameter ϕ (i.e., 60 μm) of the coated conductive wires in the sample A after the coated conductive wires S1 to S4 have moved due to the thermal load.

Next, in both samples A and B, the end S1*a* of the coated conductive wire S1 and the end S2*b* of the coated conductive wire S2 were short-circuited to each other and were connected to one test terminal (+) of a tester, and the end S1*b* of the coated conductive wire S3 and the end S4*a* of the coated conductive wire S4 were short-circuited to each other and were connected to the other test terminal (−) of a tester. Then, a 50-Hz AC voltage of was applied between the test terminals for 60 seconds, and the samples A and B were examined for dielectric breakdown. The voltage was set to initial value of 1.5 kV. If the sample was not dielectrically broken down, the voltage was raised by 0.1 kV and applied to the sample again. The voltage at which the sample reaches the dielectric breakdown was plotted. The result was as sown in FIG. 11.

Figure 11:
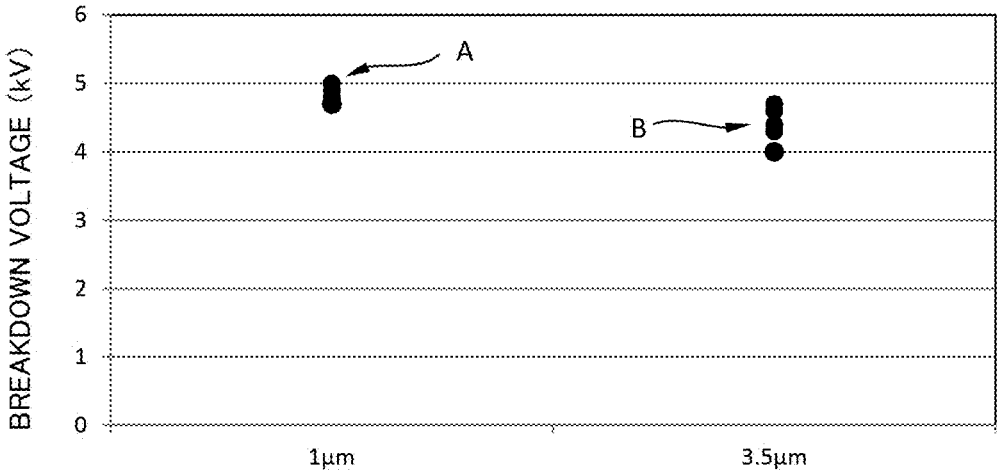
FIG. 11 is a graph indicating measurement results of a breakdown voltage.

As seen from FIG. 11, the sample A underwent dielectric breakdown when applied with voltage of 4.7 kV to 5.0 kV, and the sample B underwent dielectric breakdown when applied with voltage of 4.0 kV to 4.7 kV. Thus, the sample A had a higher breakdown voltage than the sample B.

Figure 12A:
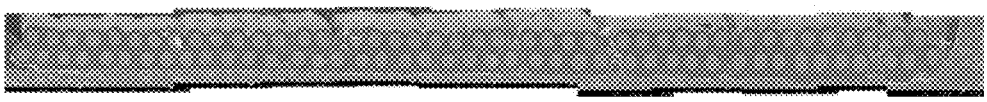
FIG. 12A shows a cross section of the sample A.
Figure 12B:
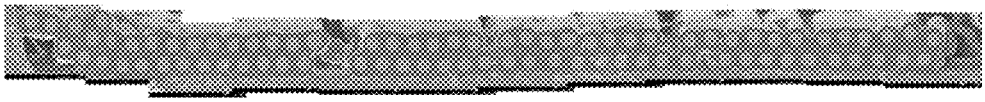
FIG. 12B shows a cross section of the sample B.

Then, the samples A and B were cut, exposing their yz-faces, which were examined by using a scanning electron microscope (SEM). FIG. 12A shows a cross section of the sample A, and FIG. 12B shows a cross section of the sample B.

As seen from FIG. 12A, the coated conductive wires S1 to S4 moved but a little in the sample A, no large voids V were not made in the resin coating layer 20. By contrast, as seen from FIG. 12B, the coated conductive wires S1 to S4 greatly moved in the sample B, large voids V were made in the resin coating layer 20, each void reaching the winding core part 11*a*. The large voids V spaced the coated conductive wires S1 and S4 constituting the first winding layer, from each other, by a distance larger than the diameter ϕ of the coated conductive wires.

What is claimed is:

1. A coil component comprising:

a drum core including a first flange portion, a second flange portion and a winding core portion positioned between the first and second flange portions;

a plurality of coated conductive wires forming a first winding layer wound around the winding core portion and a second winding layer wound around the winding core portion with an intervention of the first winding layer; and a resin coating layer covering the coated conductive wires, wherein the plurality of coated conductive wires includes first, second, third, and fourth conductive wires, wherein the first and fourth conductive wires are alternately wound in the first winding layer, and the second and third conductive wires are alternately wound in the second winding layer, wherein a maximum space between the first and fourth conductive wires in the first winding layer is narrower than a diameter of the coated conductive wires, and wherein a predetermined turn of the first conductive wire is apart from an adjacent turn of the fourth conductive wire to form a first space, and wherein the first space is filled with the resin coating layer.

2. The coil component as claimed in claim 1, wherein a maximum space between the second and third conductive wires in the second winding layer is narrower than the diameter of the coated conductive wires.

3. The coil component as claimed in claim 1, wherein each of the first and second flange portions has three or more connection portions, and each end of the coated conductive wires is connected to an associated one of the connection portions.

4. The coil component as claimed in claim 3, wherein the first and second conductive wires constitute a primary winding, and the third and fourth conductive wires constitute a secondary winding insulated from the primary winding.

5. The coil component as claimed in claim 3, wherein each of the connection portions is substantially free from the resin coating layer.

6. The coil component as claimed in claim 1, wherein the first and fourth conductive wires are electrically insulated from each other, and the second and third conductive wires are electrically insulated from each other.

7. The coil component as claimed in claim 6, wherein the first and second conductive wires are electrically connected to each other, and the third and fourth conductive wires are electrically connected to each other.

8. The coil component as claimed in claim 1, wherein a number of turns of the first to fourth conductive wires are a same as one another.

9. The coil component as claimed in claim 1, wherein the predetermined turn of the first conductive wire is apart from another adjacent turn of the fourth conductive wire opposite to the adjacent turn to form a second space, and wherein the first space is greater than the second space.

* * * * *